US012140055B2

(12) United States Patent
Schirmer

(10) Patent No.: US 12,140,055 B2
(45) Date of Patent: Nov. 12, 2024

(54) SLIDING-CAM CAMSHAFT ASSEMBLY FOR AN INTERNAL COMBUSTION ENGINE, AND METHOD FOR SWITCHING A SLIDING-CAM CAMSHAFT ASSEMBLY FOR AN INTERNAL COMBUSTION ENGINE

(71) Applicants: thyssenkrupp Dynamic Components GmbH, Ilsenburg (DE); thyssenkrupp AG, Essen (DE)

(72) Inventor: Jens Schirmer, Chemnitz (DE)

(73) Assignees: thyssenkrupp Dynamic Components GmbH, Ilsenburg (DE); thyssenkrupp AG, Essen (DE)

( * ) Notice: Subject to any disclaimer, the term of this patent is extended or adjusted under 35 U.S.C. 154(b) by 0 days.

(21) Appl. No.: 18/020,888

(22) PCT Filed: Aug. 10, 2021

(86) PCT No.: PCT/EP2021/072300
§ 371 (c)(1),
(2) Date: Feb. 10, 2023

(87) PCT Pub. No.: WO2022/034098
PCT Pub. Date: Feb. 17, 2022

(65) Prior Publication Data

US 2023/0323797 A1 Oct. 12, 2023

(30) Foreign Application Priority Data

Aug. 12, 2020 (DE) ..... 10 2020 210 267.8

(51) Int. Cl.
*F01L 1/047* (2006.01)
*F01L 13/00* (2006.01)
*F01L 1/053* (2006.01)

(52) U.S. Cl.
CPC ..... *F01L 1/047* (2013.01); *F01L 13/00* (2013.01); *F01L 13/0036* (2013.01); *F01L 2001/0537* (2013.01); *F01L 2013/0052* (2013.01)

(58) Field of Classification Search
CPC ... F01L 1/047; F01L 2001/0537; F01L 13/00; F01L 13/0036; F01L 2013/0052
See application file for complete search history.

(56) References Cited

U.S. PATENT DOCUMENTS

| | | | |
|---|---|---|---|
| 8,960,143 | B2 | 2/2015 | Meintschel et al. |
| 9,249,697 | B2 | 2/2016 | Doller |
| 10,260,380 | B2 | 4/2019 | Schmidt et al. |

FOREIGN PATENT DOCUMENTS

| | | | |
|---|---|---|---|
| DE | 10 2007 010 149 | A1 | 9/2008 |
| DE | 102007037747 | A1 | 2/2009 |

(Continued)

OTHER PUBLICATIONS

English Translation of International Search Report issued in PCT/EP2021/072300, dated Nov. 16, 2021.

*Primary Examiner* — Loren C Edwards
(74) *Attorney, Agent, or Firm* — thyssenkrupp North America, LLC

(57) ABSTRACT

The present invention relates to a sliding-cam camshaft assembly for an internal combustion engine, comprising at least a first sliding-cam camshaft with a longitudinal axis and a second sliding-cam camshaft with a longitudinal axis. The first sliding-cam camshaft comprises a support shaft and at least one sliding cam. The sliding-cam comprises a first cam and at least one second cam, and a shift gate. The second sliding-cam camshaft comprises a support shaft and at least one sliding cam. The sliding cam comprises a first cam and at least one second cam, and a shift gate. The first sliding-cam camshaft and the second sliding-cam camshaft (Continued)

are arranged parallel to one another. A transmission means for transmitting the switching state of the sliding-cam of the first sliding-cam camshaft to the sliding-cam of the second sliding-cam camshaft is arranged between the first sliding-cam camshaft and the second sliding-cam camshaft.

11 Claims, 12 Drawing Sheets

(56) References Cited

FOREIGN PATENT DOCUMENTS

| | | | | | |
|---|---|---|---|---|---|
| DE | 102007052249 | A1 | | 5/2009 | |
| DE | 102008005639 | A1 | | 7/2009 | |
| DE | 102008050776 | A1 | | 4/2010 | |
| DE | 102008060166 | A1 | | 6/2010 | |
| DE | 102010004591 | A1 | | 7/2011 | |
| DE | 102010021903 | A1 | | 12/2011 | |
| DE | 102011001123 | A1 | | 9/2012 | |
| DE | 102011002141 | A1 | | 10/2012 | |
| DE | 102011078434 | A1 | | 1/2013 | |
| DE | 102011053333 | A1 | | 3/2013 | |
| DE | 102011054218 | A1 | | 4/2013 | |
| DE | 102011116653 | A1 | | 4/2013 | |
| DE | 102011085702 | A1 | | 5/2013 | |
| DE | 102012022123 | A1 | | 5/2013 | |
| DE | 102011121684 | A1 | | 6/2013 | |
| DE | 102012022208 | A1 | | 6/2013 | |
| DE | 102012008555 | B4 | | 10/2013 | |
| DE | 102012112795 | A1 | | 6/2014 | |
| DE | 102013009757 | A1 | | 12/2014 | |
| DE | 102013111410 | A1 | | 4/2015 | |
| DE | 102013113348 | A1 | | 6/2015 | |
| DE | 102013113349 | | | 6/2015 | |
| DE | 102014007189 | A1 | | 11/2015 | |
| DE | 102014216058 | A1 | | 2/2016 | |
| DE | 102015220602 | A1 | | 4/2017 | |
| DE | 102016204892 | A1 | | 9/2017 | |
| DE | 102016005454 | A1 | | 11/2017 | |
| DE | 102016225049 | A1 | * | 6/2018 | ..... F02D 13/0215 |
| DE | 102018002860 | A1 | | 10/2019 | |
| DE | 102018111942 | A1 | | 11/2019 | |
| DE | 102018112414 | A1 | | 11/2019 | |
| DE | 102018112415 | A1 | | 11/2019 | |
| DE | 102018112416 | A1 | | 11/2019 | |
| DE | 102018112417 | A1 | | 11/2019 | |
| DE | 102018112419 | A1 | | 11/2019 | |
| DE | 102019102103 | A1 | | 11/2019 | |
| EP | 2132418 | B1 | | 12/2009 | |
| EP | 2 181 251 | B1 | | 5/2010 | |
| EP | 2 331 795 | B1 | | 6/2011 | |
| EP | 2585687 | B1 | | 5/2013 | |
| EP | 2676015 | B1 | | 12/2013 | |
| EP | 2823159 | B1 | | 1/2015 | |
| EP | 2 859 199 | B1 | | 4/2015 | |
| EP | 3365537 | B1 | | 8/2018 | |
| EP | 3401520 | B1 | | 11/2018 | |
| JP | 2012-505 333 | A | | 3/2012 | |
| WO | 2016177479 | A1 | | 11/2016 | |
| WO | 2017/067549 | A1 | | 4/2017 | |
| WO | 2018195370 | A1 | | 10/2018 | |

* cited by examiner 45
3
41b
4
41a
1
222''
122''
43
12
223
123
44
22
221'
L2
L1
121'
451
42
42b

SLIDING-CAM CAMSHAFT ASSEMBLY FOR AN INTERNAL COMBUSTION ENGINE, AND METHOD FOR SWITCHING A SLIDING-CAM CAMSHAFT ASSEMBLY FOR AN INTERNAL COMBUSTION ENGINE

CROSS REFERENCE TO RELATED APPLICATIONS

This application is a U.S. National Stage Entry of International Patent Application Serial Number PCT/EP2021/072300, filed Aug. 10, 2021, which claims priority to German Patent Application No. DE 10 2020 210 267.8, filed Aug. 12, 2020, the entire contents of which are incorporated herein by reference.

FIELD

The present disclosure generally relates to a sliding-cam camshaft assembly for an internal combustion engine and to a method for switching a sliding-cam camshaft assembly for an internal combustion engine.

BACKGROUND

A sliding-cam camshaft assembly for an internal combustion engine substantially comprises a first sliding-cam camshaft and a second sliding-cam camshaft. The first sliding-cam camshaft comprises a support shaft and at least one sliding cam. The sliding cam per se comprises a first cam pack which has at least two part cams with different cam contours, a shift gate and preferably a second cam plate which has at least two part cams with different cam contours. The second sliding-cam camshaft comprises a support shaft and at least one sliding cam. The sliding cam per se comprises a first cam pack which has at least two part cams with different cam contours, a shift gate and preferably a second cam pack which has at least two part cams with different cam contours. The difference in the cam contour can also be produced by way of different phase angles of two identical part cams.

The sliding cam is usually displaced by an electrically actuated actuator, in which an actuator pin is moved into the shift gate, as a result of which the sliding cam is moved into the desired axial position, with the result that the desired part cam can be moved into use for the sliding-cam camshaft assembly. Sliding-cam systems of this type are well-known to a person skilled in the art. They serve substantially to optimize gas exchange operations in combustion engines or internal combustion engines.

According to the prior art, each sliding cam is actuated by an associated actuator. This leads to weight, costs and control complexity.

DE 10 2016 225 049 A1 has disclosed a sliding-cam camshaft assembly for an internal combustion engine, comprising a first camshaft and a second camshaft, a respective camshaft having a cam piece which is arranged axially displaceably and fixedly for conjoint rotation, the cams which are formed respectively on the cam pieces having at least two part cams of different and axially following configuration with cam contours, and the axial displacement of the cam pieces taking place via at least one actuator element, the first cam piece which is arranged on the first camshaft being operatively connected in an axially displaceable manner in a connecting portion of the respective cam pieces via a coupling mechanism to the second cam piece which is arranged on the second camshaft. Here, the coupling mechanism comprises an axially displaceable (that is to say, displaceable in the camshaft direction) connecting element or peripheral shaped-out portion.

Thus a need exists for an improved sliding-cam camshaft assembly for an internal combustion engine, in particular of proposing a sliding-cam camshaft assembly which does not have an additional axially displaceable connecting element, and is of cost-saving, installation space-reducing, weight-reducing and/or less complex configuration.

According to the invention, a sliding-cam camshaft assembly for an internal combustion engine is provided. By virtue of the fact that the transmission means comprises a first thrust rod and a second thrust rod, a sliding-cam camshaft assembly can be provided which manages, for example, without an axially displaceable connecting element, since the two axial movements of the remote-controlled sliding cam of the second sliding-cam camshaft can be enacted by way of the use of two thrust rods. The thrust rods can be of transversely displaceable configuration with regard to the longitudinal axes of the camshafts, as a result of which a cost-saving, installation space-reducing, weight-reducing and/or less complex construction of the sliding-cam camshaft assembly or the transmission means can be enacted.

DETAILED DESCRIPTION

Figure 1:
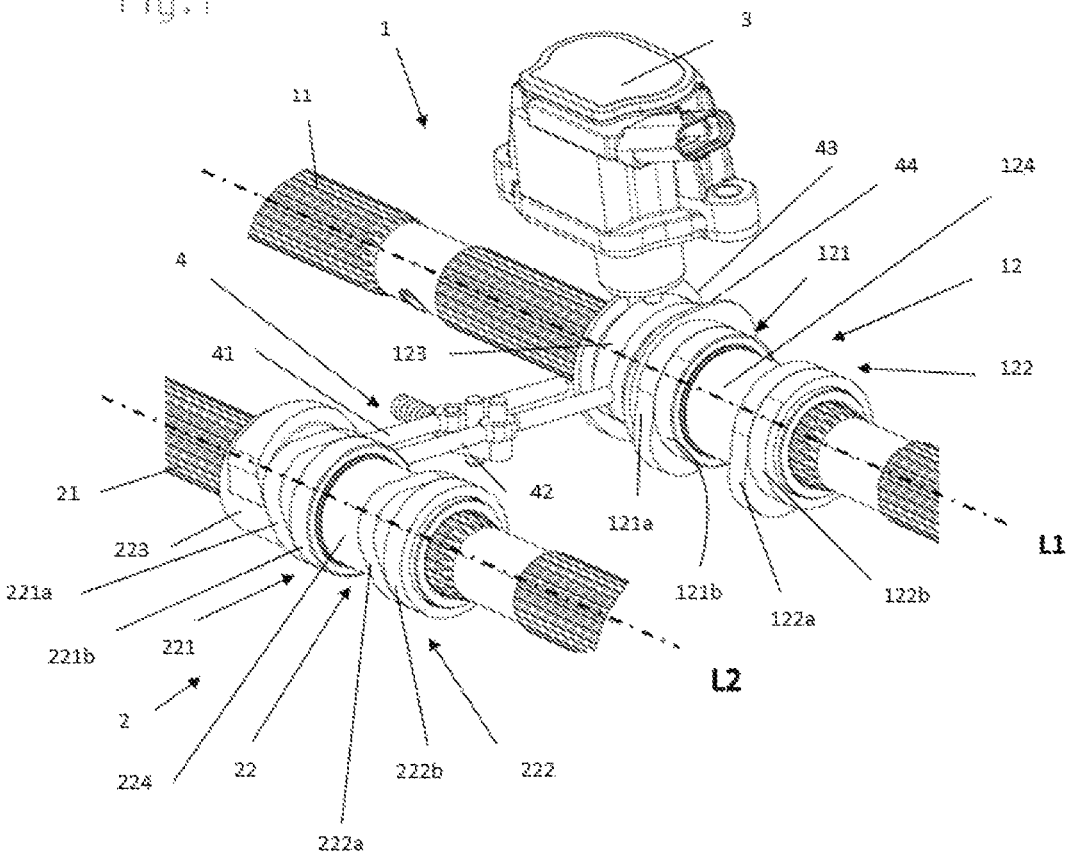
FIG. 1 is a perspective view of a sliding-cam camshaft assembly according to the invention for an internal combustion engine.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

It can be provided in one advantageous refinement of the present invention that the transmission means comprises a first actuating means for the first thrust rod and a second actuating means for the second thrust rod, the actuating means being attached, in particular at an axial spacing from one another, to the sliding cam of the first sliding-cam camshaft or being shaped from said sliding cam. As a result of this measure, no further components are required for the realization of the actuating means.

It can be provided in a further advantageous refinement of the invention that the first actuating means is configured as a first radial lifting cam profile, the second actuating means being configured as a second radial lifting cam profile, the actuating means being arranged, in particular at different axial positions, on the sliding cam, in particular on the shift gate of the sliding cam, of the first sliding-cam camshaft or being configured from the latter. As a result of this measure, no further components are required for the realization of the actuating means.

It can be provided in a further advantageous refinement of the invention that the first thrust rod has a first end which faces the first sliding-cam camshaft, the first thrust rod having a second end which faces the second sliding-cam camshaft, the second thrust rod having a first end which faces the first sliding-cam camshaft, the second thrust rod having a second end which faces the second sliding-cam camshaft.

It can be provided in a further advantageous refinement of the invention that the thrust rods are configured such that they can be displaced between at least two positions, in particular a first position, in which the first end of the first thrust rod is further away from the first sliding-cam camshaft and the second end of the first thrust rod is closer to the second sliding-cam camshaft, and the first end of the second thrust rod is closer to the first sliding-cam camshaft and the second end of the second thrust rod is further away from the second sliding-cam camshaft, and a second position, in which the first end of the first thrust rod is closer to the first sliding-cam camshaft and the second end of the first thrust rod is further away from the second sliding-cam camshaft, and the first end of the second thrust rod is further away from the first sliding-cam camshaft and the second end of the second thrust rod is closer to the second sliding-cam camshaft.

It can be provided in a further advantageous refinement of the invention that the first thrust rod is coupled via a coupling means to the second thrust rod, the coupling means being configured such that an axial movement of the first thrust rod brings about an opposed axial movement of the second thrust rod.

It can be provided in a further advantageous refinement of the invention that the coupling means is configured as a coupling lever which is connected in an articulated manner to the two thrust rods, the coupling lever being attached to a rotational axle between the two thrust rods, the rotational axle being oriented perpendicularly with respect to the thrust rods or their displacement directions.

It can be provided in a further advantageous refinement of the invention that the transmission means is equipped with a latching means, in particular in the form of a spring/ball mechanism, which is configured to hold the thrust rods releasably in a predefined position.

It can be provided in a further advantageous refinement of the invention that at least one of the thrust rods, in particular the two thrust rods, is/are oriented perpendicularly with respect to the longitudinal direction of the sliding-cam camshafts, or that the thrust rods are oriented at an angle $\alpha$ of between 45° and 90°, preferably at an angle $\alpha$ of between 60° and 80°, with respect to the longitudinal direction of the sliding-cam camshaft. The perpendicular orientation is particularly space-saving, and the oblique orientation makes adaptations possible between the actuating means of the first sliding-cam camshaft and the shift gate of the second sliding-cam camshaft.

It can be provided in a further advantageous refinement of the invention that the thrust rods are configured in one piece, or that the thrust rods are of split configuration as thrust rod segments and are attached in each case in an articulated manner to the coupling means.

Furthermore, the present invention relates to a method for switching a sliding-cam camshaft assembly for an internal combustion engine as claimed in at least one of the preceding claims.

An advantageous method for switching the sliding-cam camshaft assembly according to the invention for an internal combustion engine is proposed by the method steps as claimed in claim 13.

The following designations are used in the figures:

$L_1$, $L_2$ longitudinal axes of the sliding-cam camshafts
1 sliding-cam camshaft
2 sliding-cam camshaft
3 actuator
4 transmission means
11 support shaft
12 sliding cam
21 support shaft
22 sliding cam
41 first thrust rod
41*a* first thrust rod segment
41*b* second thrust rod segment
42 second thrust rod
42*a* first thrust rod segment
42*b* second thrust rod segment
43 first actuating means
44 second actuating means
45 coupling means
46 latching means
121 first cam pack
121*a* first part cam
121*b* second part cam
122 second cam pack
122*a* first part cam
122*b* second part cam
123 shift gate
124 sliding-cam sleeve
121' third cam pack
122' fourth cam pack
221 first cam pack
221*a* first part cam

221*b* second part cam
222 second cam pack
222*a* first part cam
222*b* second part cam
223 shift gate
224 sliding-cam sleeve
221' third cam pack
222' fourth cam pack
411 first end (of the first thrust rod)
412 second end (of the first thrust rod)
421 first end (of the second thrust rod)
422 second end (of the second thrust rod)
451 rotational axle Reference is made first of all to FIG. 1:

A sliding-cam camshaft assembly according to the invention for an internal combustion engine comprises at least a first sliding-cam camshaft 1 and a second sliding-cam camshaft 2. The first sliding-cam camshaft 1 comprises a support shaft 11 and at least one sliding cam 12. The sliding cam 12 per se comprises a first cam pack 121 which has at least two part cams 121*a*, 121*b* with different cam contours, a shift gate 123 and preferably at least a second cam pack 122 which has at least two part cams 122*a*, 122*b* with different cam contours 122*a*, 122*b*. The cam packs and shift gate are attached to a sliding sleeve 124 or are configured in one piece with the latter.

The second sliding-cam camshaft 2 comprises a support shaft 21 and at least one sliding cam 22. The sliding cam 22 per se comprises a first cam pack 221 which has at least two different cam contours 221*a*, 221*b*, a shift gate 223 and preferably at least one second cam pack 222 which has at least two different cam contours 222*a*, 222*b*. The cam packs and shift gate are attached to a sliding sleeve 224 or are configured in one piece with the latter.

The first sliding-cam camshaft 1 and the second sliding-cam camshaft 2 are arranged parallel to one another.

The sliding cams 12 and 22 and sliding sleeves 124 and 224 are arranged fixedly for conjoint rotation but axially displaceably on the support shaft 11 and 21, respectively. For orientation, the longitudinal direction L1 and L2 of the sliding-cam camshaft 1 and 2, respectively, is illustrated. Different control times for the valves of an internal combustion engine can be enacted by the part cams with different cam contours.

Moreover, the sliding-cam camshaft assembly for an internal combustion engine is equipped with an actuator 3 which interacts with the shift gate 123 of the first sliding-cam camshaft 1. Here, the actuator pin of the actuator 3 engages, depending on the desired switching state, into the shift gate 123 of the first sliding-cam camshaft 1 and in the process displaces the sliding cam 12 of the first sliding-cam camshaft 1 into the desired axial position, with the result that the first part cams 121*a*, 122*a* or the second part cams 121*b*, 122*b* of the cam packs 121 and 122 in turn actuate the respective valves (not shown). The sliding cam 12 of the first sliding-cam camshaft 1 can therefore be displaced by the actuator 3 between a first switching state and at least a second switching state. The sliding-cam camshaft assembly is as a rule installed in a cover module and can also be called a valve train or can be part of a valve train for an internal combustion engine. The cover module is as a rule completed to form a cylinder head and is installed in an internal combustion engine. The operating principle of a sliding-cam camshaft is well known to a person skilled in the art, with the result that further details will not be given here.

It is provided that a transmission means 4 is arranged between the first sliding-cam camshaft 1, in particular the sliding cam 12 of the first sliding-cam camshaft 1, and the second sliding-cam camshaft 2, in particular the sliding cam 22 of the second sliding-cam camshaft 2. In other words, the sliding cam 22 of the second sliding-cam camshaft 2 is actuated via the transmission means 4 and therefore indirectly also by the actuator 3 of the first sliding-cam camshaft 1 and not by a dedicated second actuator. As a result, an actuator, that is to say an actuator for the second sliding-cam camshaft 2, in particular for the sliding cam 22 of the second sliding-cam camshaft 2, can be dispensed with.

The transmission means 4 is preferably a purely mechanical device. One embodiment according to the invention of a transmission means 4 comprises a first thrust rod 41 and a second thrust rod 42 and, in particular, a first actuating means 43 for the first thrust rod 41 and a second actuating means 44 for the second thrust rod 42, the actuating means preferably being attached at an axial spacing from one another to the sliding cam 12 of the first sliding-cam camshaft 1 or being formed from the latter.

The thrust rods 41, 42 are preferably oriented perpendicularly with respect to the longitudinal direction $L_1$, $L_2$ of the sliding-cam camshafts 1, 2. To this extent, the thrust rods can be displaced radially with regard to the sliding-cam camshafts 1, 2. It is to be assumed that the first end 411 and 421 of the respective thrust rod 41 and 42, respectively, faces the first sliding-cam camshaft 1, while the second end 412 and 422 of the respective thrust rod 41 and 42, respectively, faces the second sliding-cam camshaft 2.

The transmission means 4, in particular each thrust rod 41 and 42, can be displaced between at least two positions, in particular

- a first position, in which the first end 411 of the first thrust rod 41 is further away from the first sliding-cam camshaft 1 and the second end 412 of the first thrust rod 41 is closer to the second sliding-cam camshaft 2, and the first end 421 of the second thrust rod 42 is closer to the first sliding-cam camshaft 1 and the second end 422 of the second thrust rod 42 is further away from the second sliding-cam camshaft 2, and
- a second position, in which the first end 411 of the first thrust rod 41 is closer to the first sliding-cam camshaft 1 and the second end 412 of the first thrust rod 41 is further away from the second sliding-cam camshaft 2, and the first end 421 of the second thrust rod 42 is further away from the first sliding-cam camshaft 1 and the second end 422 of the second thrust rod 42 is closer to the second sliding-cam camshaft 2.

The first actuating means 43 can be configured, for example, as a first radial lifting cam profile.

The second actuating means 44 can be configured, for example, as a second radial lifting cam profile.

The actuating means 43 and 44 are arranged, preferably at different axial positions, on the sliding cam 12, in particular on the shift gate 123, of the first sliding-cam camshaft 1 or are configured therefrom. As a result of the axial displacement capability of the sliding cam 11, the actuating means 43 and 44 can also be displaced axially along the longitudinal axis $L_1$ and $L_2$ and therefore relative to the thrust rods 41 and 42, respectively, which are oriented radially with respect thereto, with the result that different positions of the actuating means 43 and 44 can result with regard to the associated thrust rod 41 and 42, respectively. It can thus be seen clearly in FIG. 2, for example, that the first end 411 of the first thrust rod 41 is positioned in front of the first actuating means 43, that is to say is substantially aligned with it, while the first end 421 of the second thrust rod 42 is positioned next to the second actuating means 44, that is to say is not aligned with it. Although the first end 411 of the first thrust rod 41 is positioned in front of the first actuating means 43, the first actuating means 43 runs freely, since the first end 411 of the first thrust rod 41 is far enough away from the first sliding-cam camshaft 1, in particular the first actuating means 43. The second actuating means 44 likewise runs freely, since the first end 421 of the second thrust rod 42 is arranged next to the second actuating means 44, although the first end 421 of the second thrust rod 42 might be positioned close enough to the first sliding-cam camshaft 1 and fundamentally might be actuated by the second actuating means 44 if it were aligned with it.

Further details of the proposed invention result, in particular, from the description of a switching operation. The starting point is the situation according to FIGS. 1 to 3. It goes without saying that the camshafts rotate during the switching operation.

The switching operation is now initiated by the actuator 3, and the actuator pin of the actuator 3 moves into the shift gate of the sliding cam 12 of the first sliding-cam camshaft 1. As a consequence of this, the sliding cam 12 of the first sliding-cam camshaft 1 is displaced axially. This process is well known to a person skilled in the art and does not require any further explanation.

The second actuating means 44 is then likewise positioned in front of the first end 421 of the second thrust rod 42, however, with the result that the second thrust rod 42 is actuated and is displaced out of a position away from the second sliding-cam camshaft 2, in particular away from the shift gate 223 of the second sliding-cam camshaft 2, in the direction of the second sliding-cam camshaft 2 into a position close to the second sliding-cam camshaft 2.

This in turn has the consequence that the second end 422 of the second thrust rod 42 dips into the shift gate 223 of the sliding cam 22 of the second sliding-cam camshaft 2, and the sliding cam 22 of the second sliding-cam camshaft 2 is displaced axially out of a first switching state into a second switching state.

The first thrust rod 41 is preferably coupled to the second thrust rod 42 in such a way that an axial movement of the first thrust rod 41 brings about an opposed axial movement of the second thrust rod 42, and vice versa. In other words, if the first end of the first thrust rod 41 moves toward the first sliding-cam camshaft 1, the first end of the second thrust rod 42 moves away from the first sliding-cam camshaft 1, and vice versa.

This can be realized, for example, by a coupling means 45, in particular a coupling lever, which is connected in an articulated manner to the two thrust rods 41, 42, and is attached to a rotational axle 451 between the two thrust rods, the rotational axle 451 preferably being oriented perpendicularly with respect to the thrust rods 41, 42 or their displacement directions.

To this extent, the first thrust rod 41 is displaced by the coupling means 45 in the opposed direction, that is to say in the direction of the first sliding-cam camshaft 1. The first actuating element 43 is not arranged in front of, but rather next to the first end 411 of the first thrust rod 41, however, with the result that the thrust rod 41 remains in this state as long as the sliding cam 12 of the first sliding-cam camshaft 1 is not transferred back into the first switching state.

If the sliding cam 12 of the first sliding-cam camshaft 1 were transferred by the actuator 3 into the first switching state again, the first actuating means 43 would actuate the first thrust rod 41, and the second end 412 of the first thrust rod 41 would dip into the shift gate 223 of the sliding cam 22 of the second sliding-cam camshaft 2, and would likewise transfer it into the first switching state again.

Figure 2:
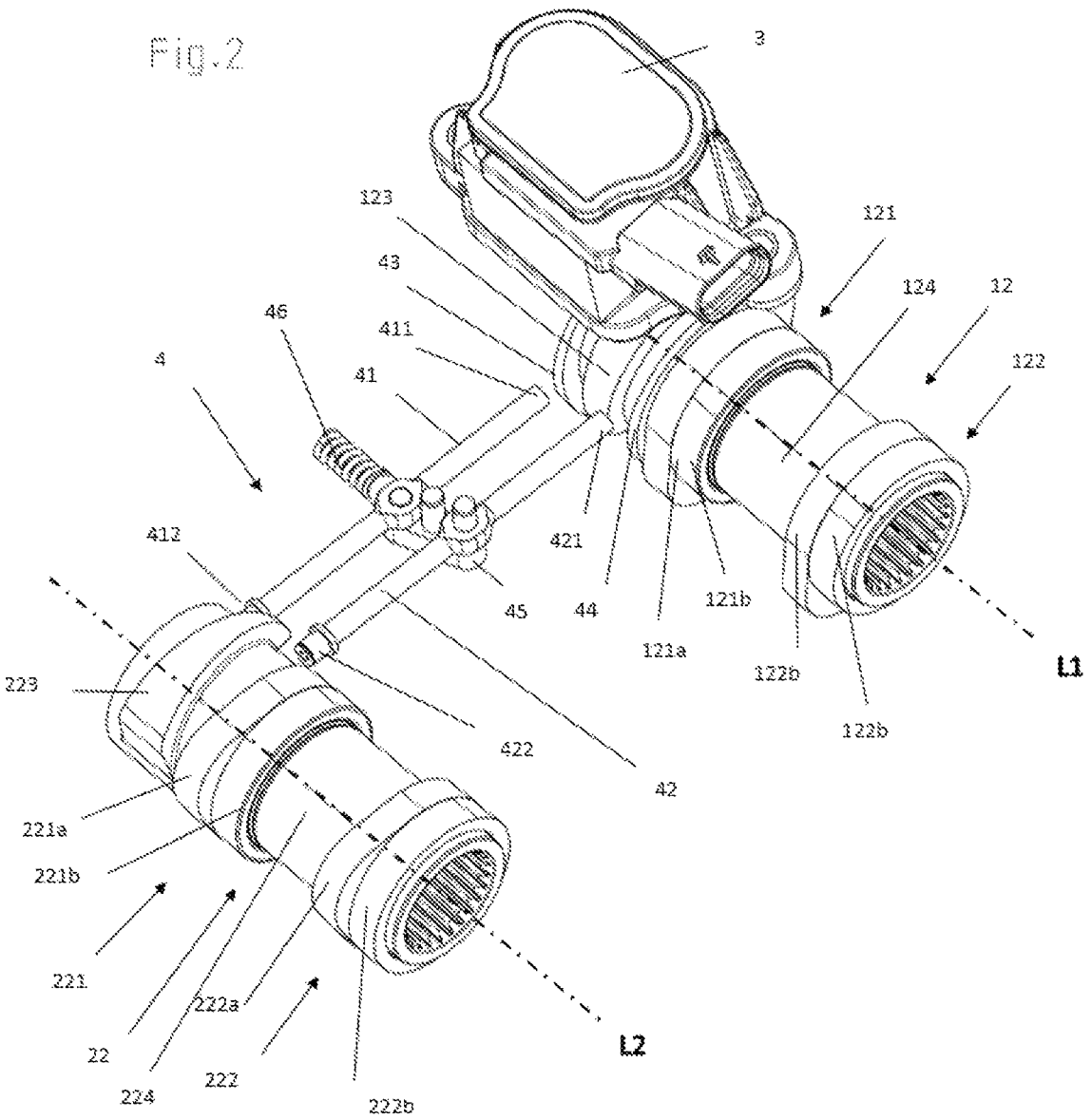
FIG. 2 is a perspective view of a sliding-cam camshaft assembly according to the invention for an internal combustion engine without support shafts (first switching state).
Figure 3:
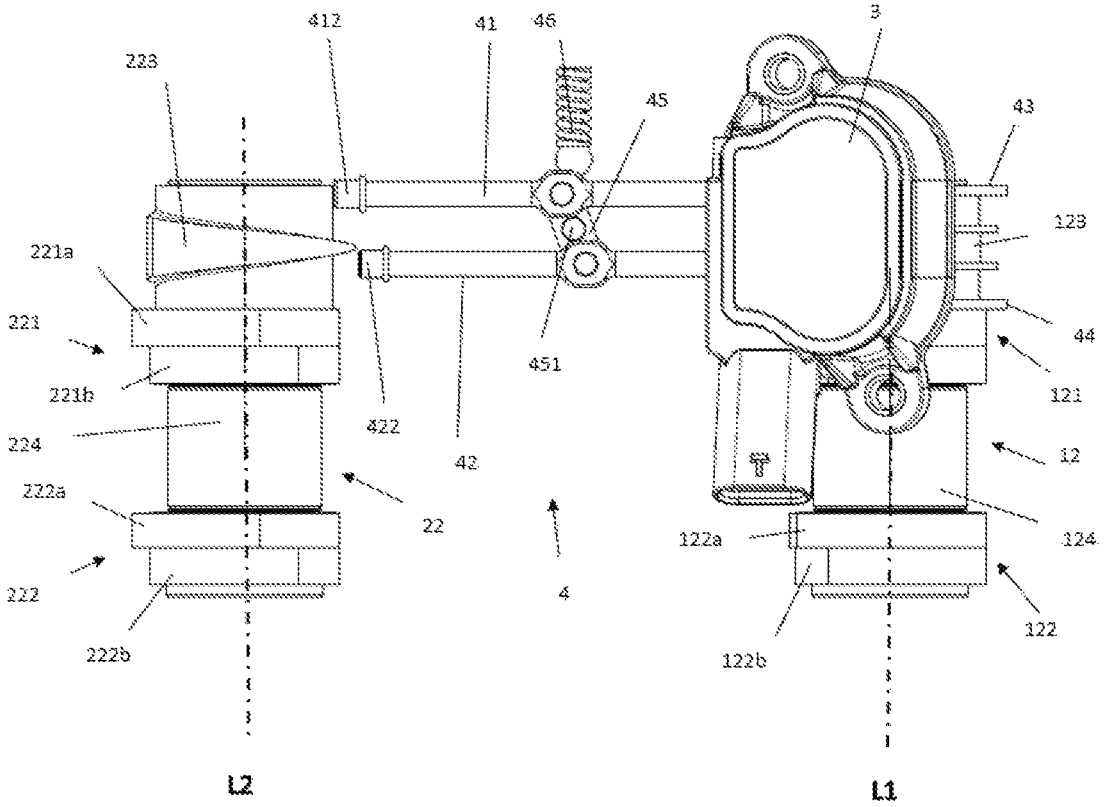
FIG. 3 is a plan view of a sliding-cam camshaft assembly according to the invention for an internal combustion engine without support shafts in a plan view (first switching state).
Figure 4:
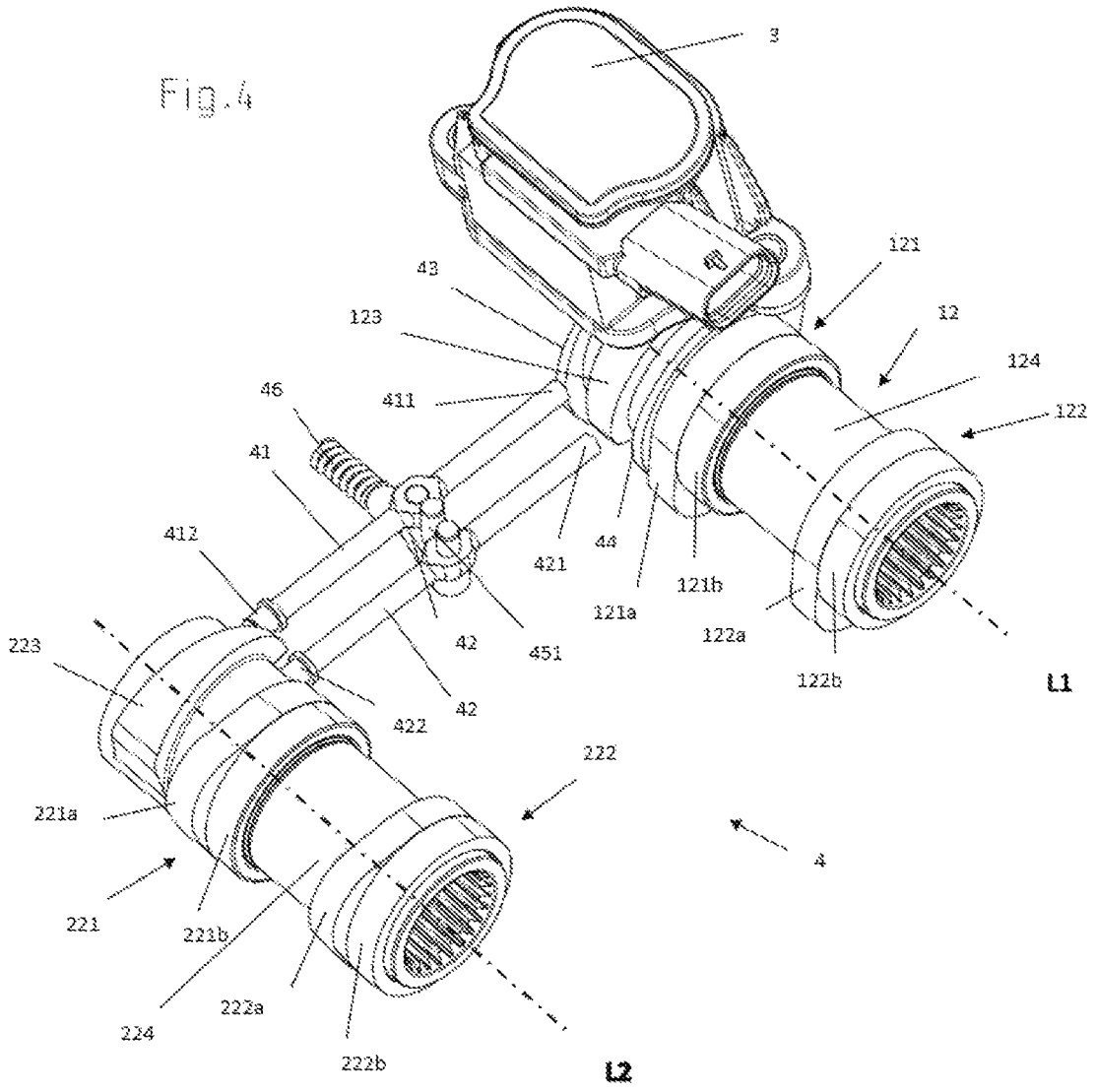
FIG. 4 is a perspective view of a sliding-cam camshaft assembly according to the invention for an internal combustion engine without support shafts (second switching state).
Figure 5:
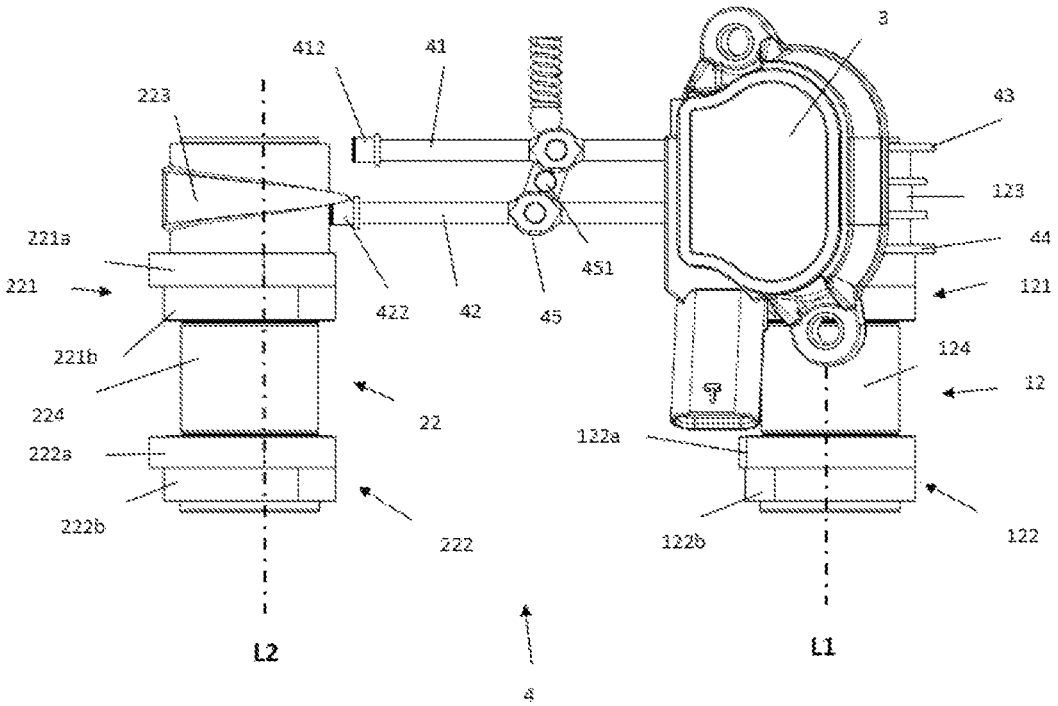
FIG. 5 is a plan view of a sliding-cam camshaft assembly according to the invention for an internal combustion engine without support shafts (second switching state).
Figure 6:
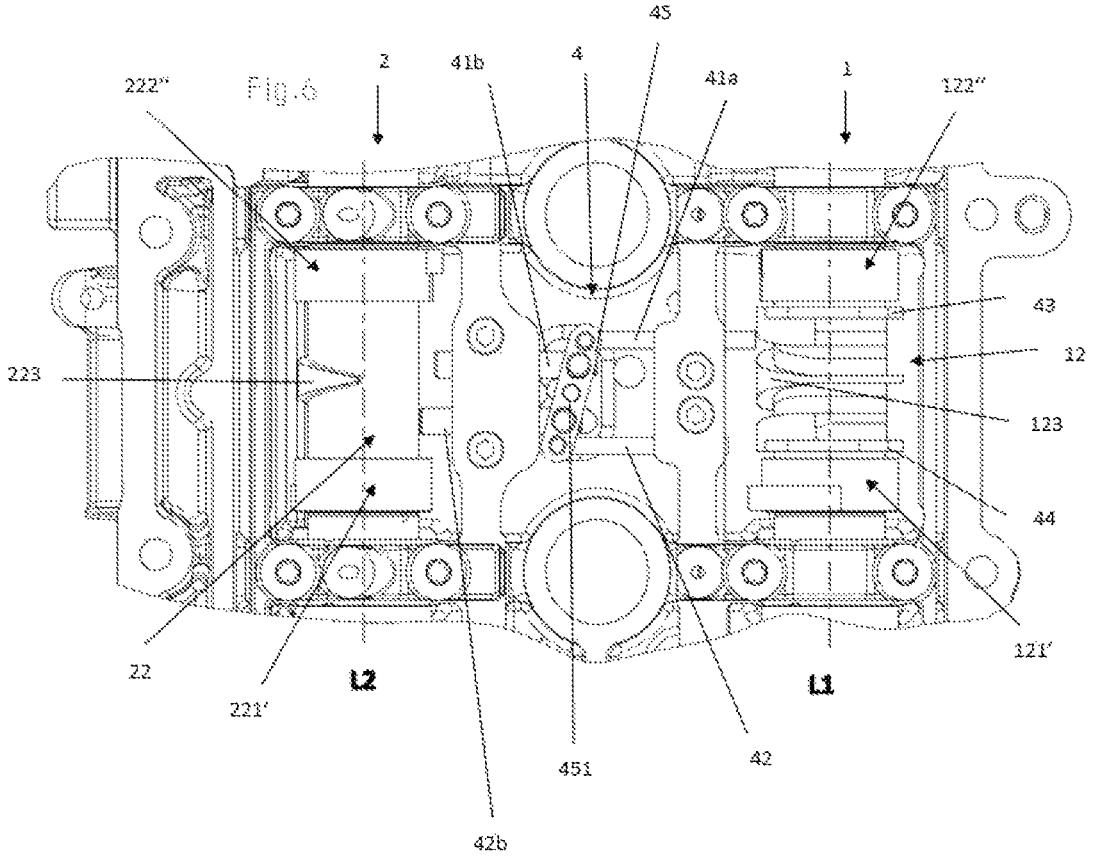
FIG. 6 is a plan view a sliding-cam camshaft assembly according to the invention for an internal combustion engine (without actuator) in a cover module.
Figure 7:
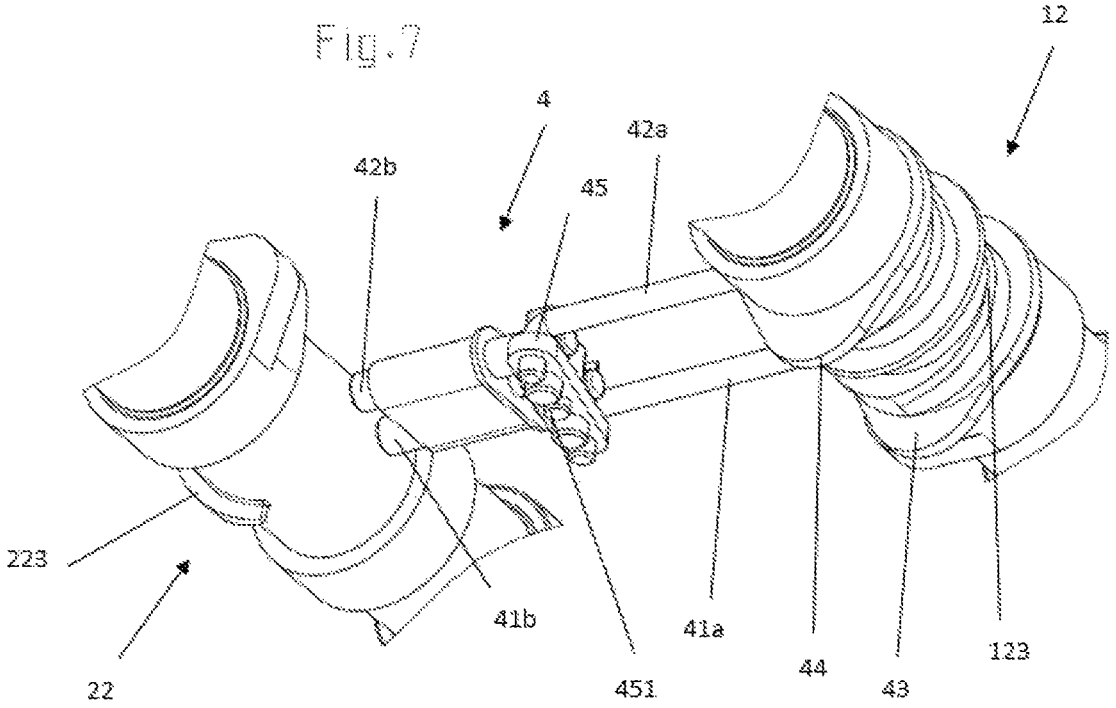
FIG. 7 is a perspective view of an one embodiment of a transmission means for a sliding-cam camshaft assembly according to the invention for an internal combustion engine.
Figure 8:
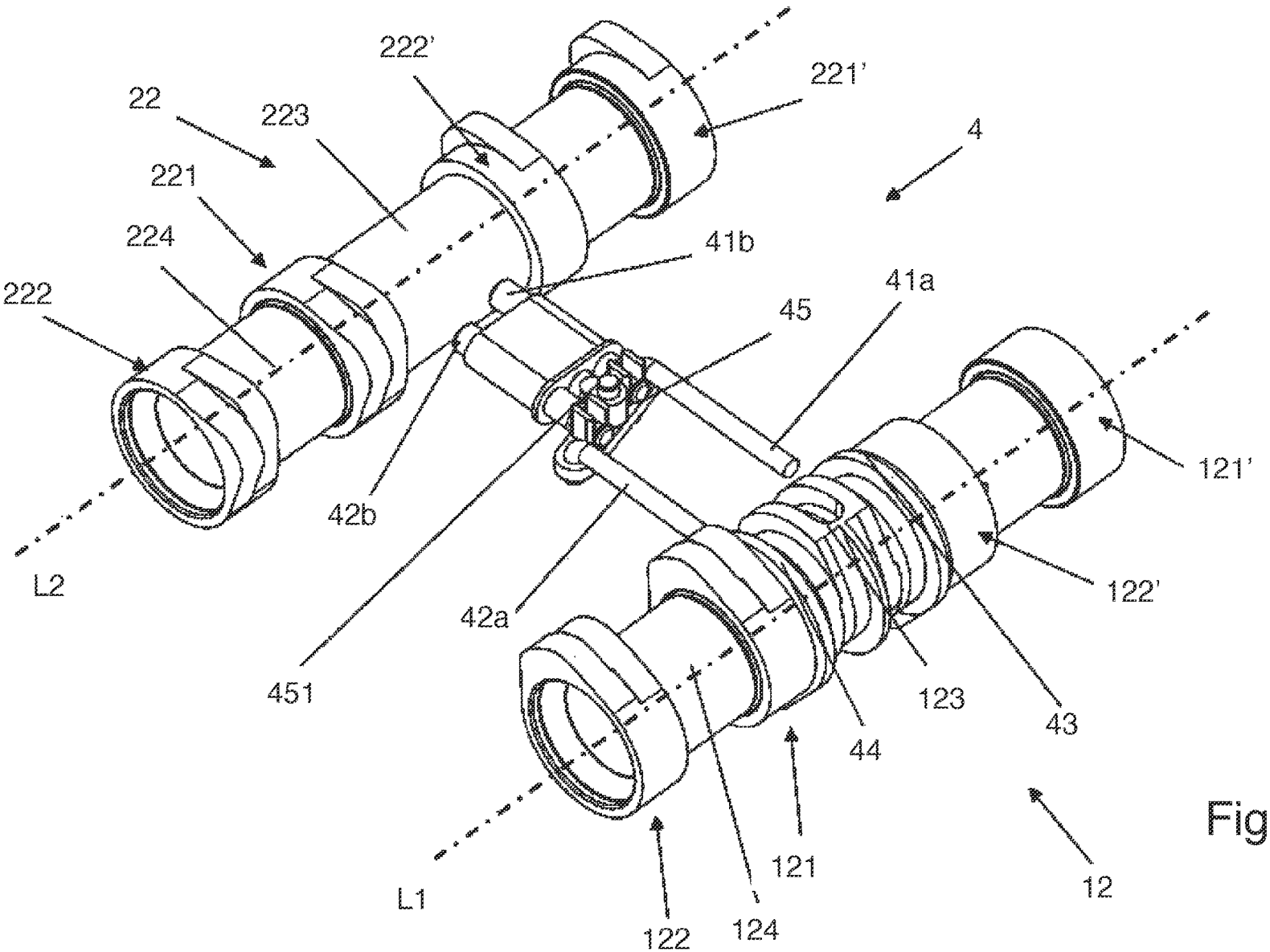
FIG. 8 is a perspective view of a sliding-cam camshaft assembly according to the invention for an internal combustion engine without support shafts.
Figure 9:
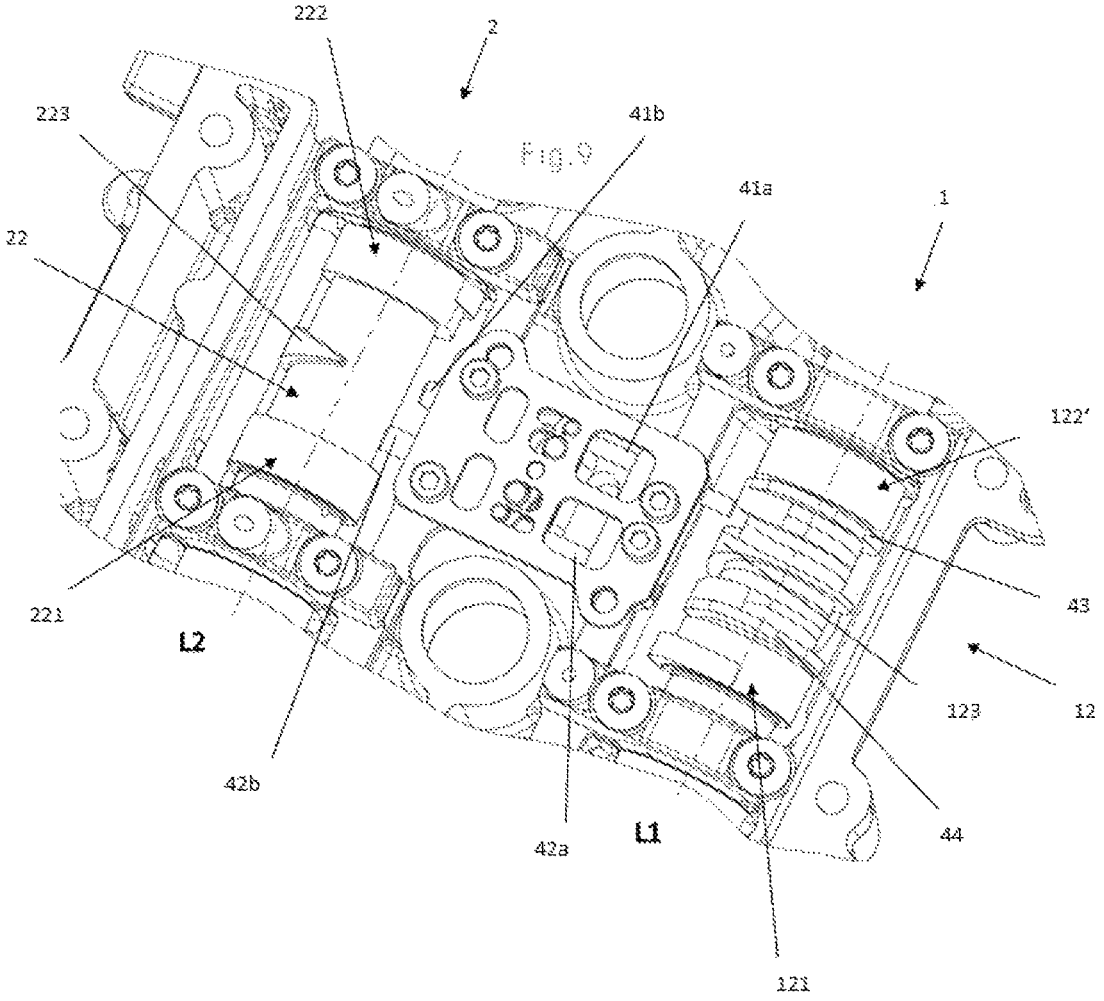
FIG. 9 is a perspective view of a sliding-cam camshaft assembly according to the invention for an internal combustion engine (without actuator) in a cover module.

The coupling means 45 likewise displaces the second thrust rod 42 and the thrust rods 41, 42, and the transmission means is situated again in a state as in FIG. 2.

Moreover, the transmission means 4 can be equipped with a latching means 46, for example in the form of a spring/ball mechanism, which holds the thrust rods 41, 42 releasably in the predefined position, for example despite vibrations of the internal combustion engine, in which the proposed sliding-cam camshaft assembly is usually installed.

It can be seen that a "remote control" of the second sliding-cam camshaft 2 by way of the first sliding-cam camshaft 1 can take place via the transmission means 4. The transmission means 4 is configured in such a way that it is activated only in the case of a change in the switching state of the sliding cam of the first sliding-cam camshaft and is otherwise in a freewheel state. In other words, as a result of the transmission means 4, the sliding cam 22 of the second sliding-cam camshaft 2 follows the switching state of the sliding cam 12 of the first sliding-cam camshaft 1.

A further embodiment of the present invention is shown in FIGS. 6 to 9. The transmission means which is shown here differs, in particular, in that the thrust rods per se are split, that is to say thrust rod segments 41*a* and 41*b* and thrust rod segments 42*a* and 42*b* are provided and articulated in each case on the coupling means. This embodiment is preferably provided for the actuation of shift gates with different axial widths, in the case of which actuating means which are arranged on the shift gates are therefore at different axial spacings. For this purpose, a transmission ratio can be generated via the articulation on the coupling means. In addition, for example, the thrust rod segments 41*a* and 42*a* which face the first sliding-cam camshaft 1 can be spaced apart from one another further than the thrust rod segments 41*b* and 42*b*, with the result that actuating means 43, 44 which lie relatively far apart from one another axially can also be achieved.

The design and/or the installation space requirements of the shift gate 123 which is actuated by the actuator 3 substantially defines/define the spacing of the thrust rods 41, 42 from one another and therefore also the axial position and width of the shift gate 223 which lies opposite. The shift gate 223 (which can also respond as a passive shift gate) of the second sliding-cam camshaft 2 can be of particularly simple and space-saving and weight-saving configuration; in particular, ejection ramps for an actuator pin of a correspondingly not present actuator are dispensed with for this shift gate 223.

The examples from the figures are to be addressed again for further clarification of the respective installation space requirements.

Thus, FIGS. 1 to 5 show the switching of the inlet/outlet valves (not shown) by means of two individual sliding cams 12, 22 and an actuator 3. On account of the design of the first shift gate, the actuating elements for the second/passive displacement guide plate can be arranged in such a way that the thrust rods are not split and are parallel to one another, and are oriented perpendicularly with respect to the longitudinal direction of the sliding-cam camshafts and can thus interact directly with the shift gate 223 of the second sliding-cam camshaft 2. The actuating elements on the participating shift gates are preferably at identical axial spacings.

Furthermore, FIGS. 6 to 9 show the switching of the inlet/outlet valves by means of two double sliding cams and an actuator. Here, instead of individual sliding cams, double sliding cams are installed, for example, which as a rule require spatially more extended shift gates for the actuator. The double sliding cams are fundamentally distinguished by the fact that they comprise four cam packs and only one shift gate. The respective part cams of the further cam packs are correspondingly labeled analogously with the designations 121', 122' and 221', 222'. The shift gate of the second sliding-cam camshaft, that is to say the remote-controlled shift gate, requires less spatial extent, however, in particular in the axial direction, than the controlling shift gate with the actuating means on the first sliding-cam camshaft. The shift gates are therefore substantially of different width. Here, the transmission means with a coupling means preferably comes into question. The thrust rods are split and are parallel to one another at different width, and are arranged perpendicularly with respect to the longitudinal direction of the sliding-cam camshafts. The coupling means acts as a type of transmission gear mechanism for the thrust rods which are split in two. Here, the latching means can also be arranged on the coupling means between the split thrust rods.

Figure 10:
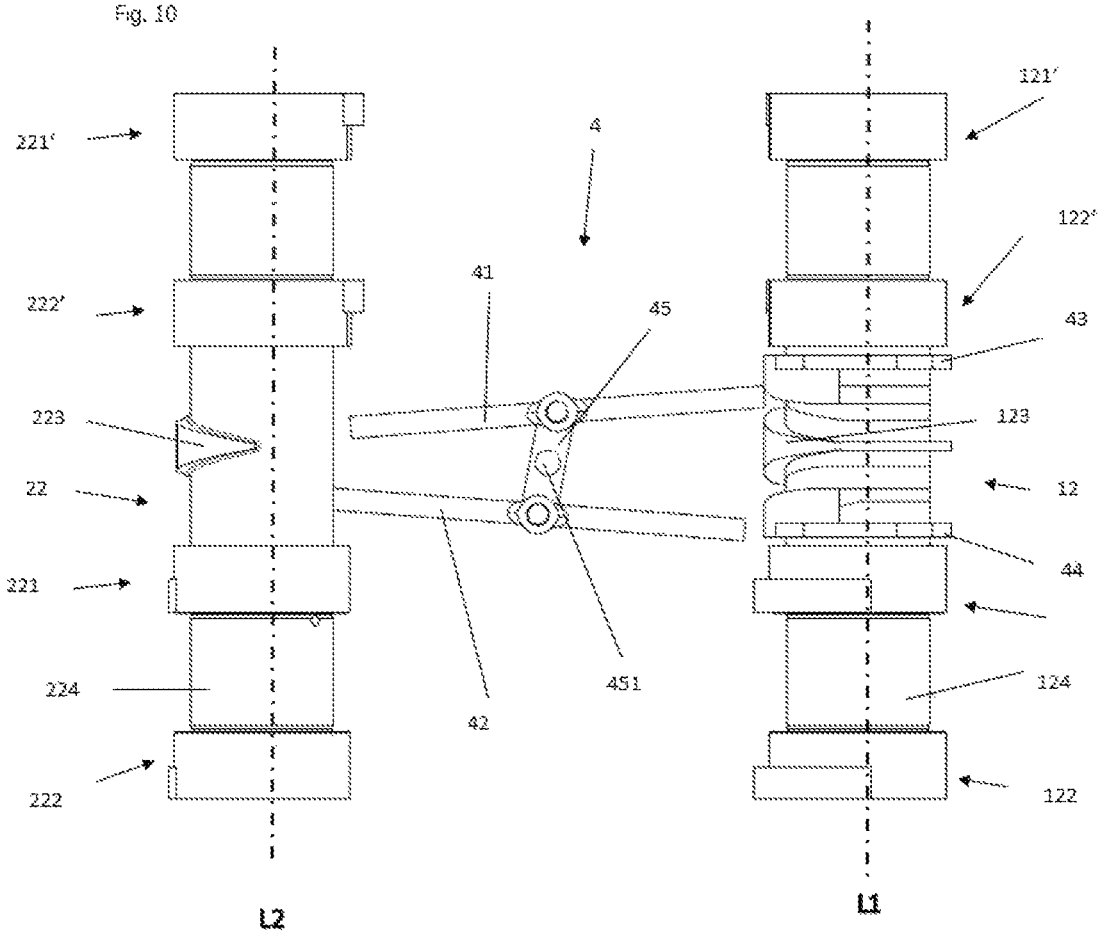
FIG. 10 is a side view of a sliding-cam camshaft assembly according to the invention for an internal combustion engine with obliquely positioned thrust rods.
Figure 11:
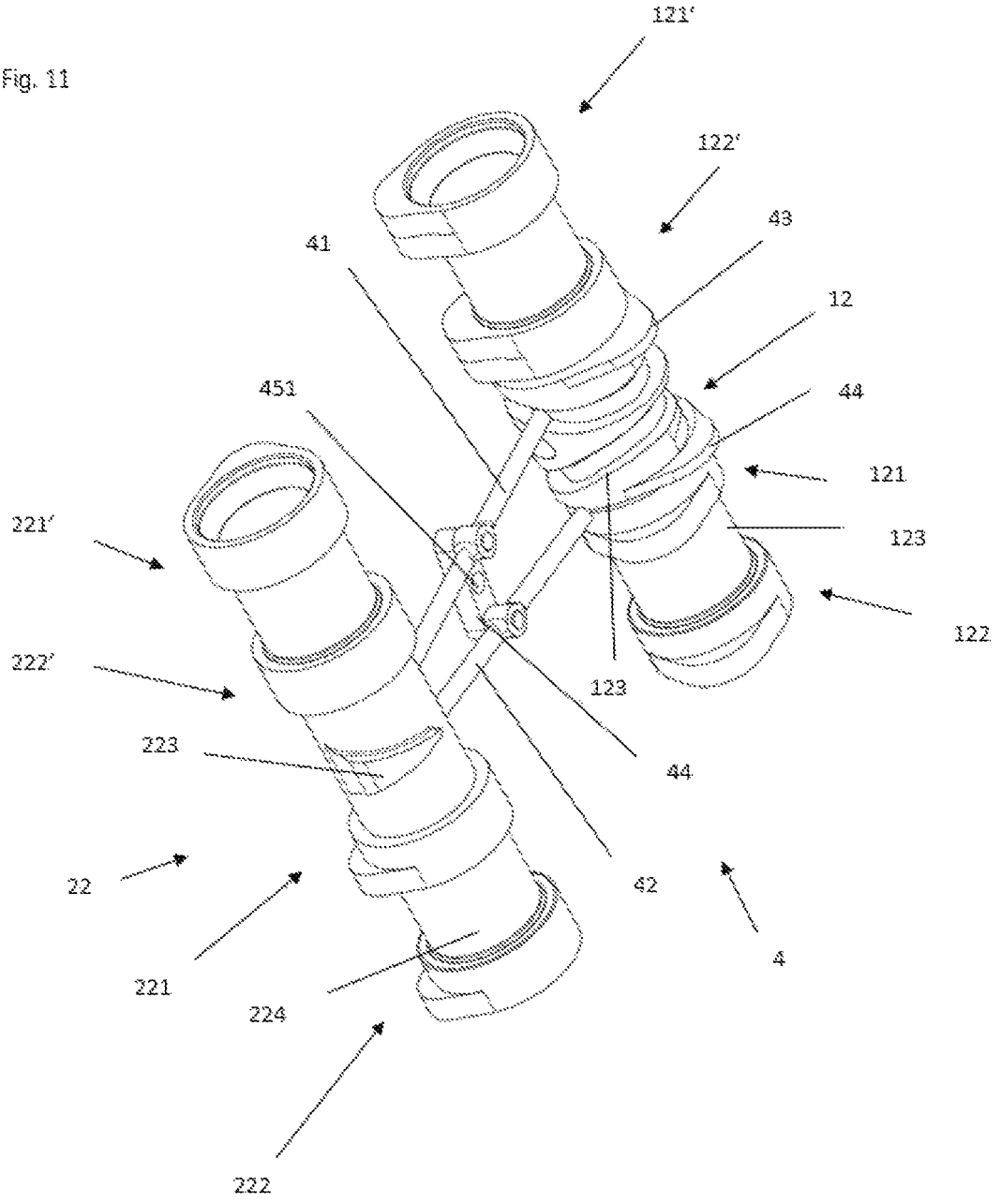
FIG. 11 is a perspective view of a sliding-cam camshaft assembly according to the invention for an internal combustion engine with obliquely positioned thrust rods.

Moreover, FIGS. 10 and 11 show one embodiment of the transmission means, in the case of which, although the thrust rods are not split, they do not run parallel to one another. The thrust rods are arranged obliquely with respect to the longitudinal direction of the sliding-cam camshafts. Angles $\alpha$ of the thrust rods with respect to one another of between 45° and 90° are conceivable, acute angles of between 60° and 80° preferably being provided. The contact surfaces of the thrust rod ends are preferably shaped to avoid point contact; it is intended that no stress peaks occur. This embodiment is preferably also suitable, just like the embodiment with the split and offset thrust rods, for shift gates with a different spatial extent in the axial direction.

Figure 12:
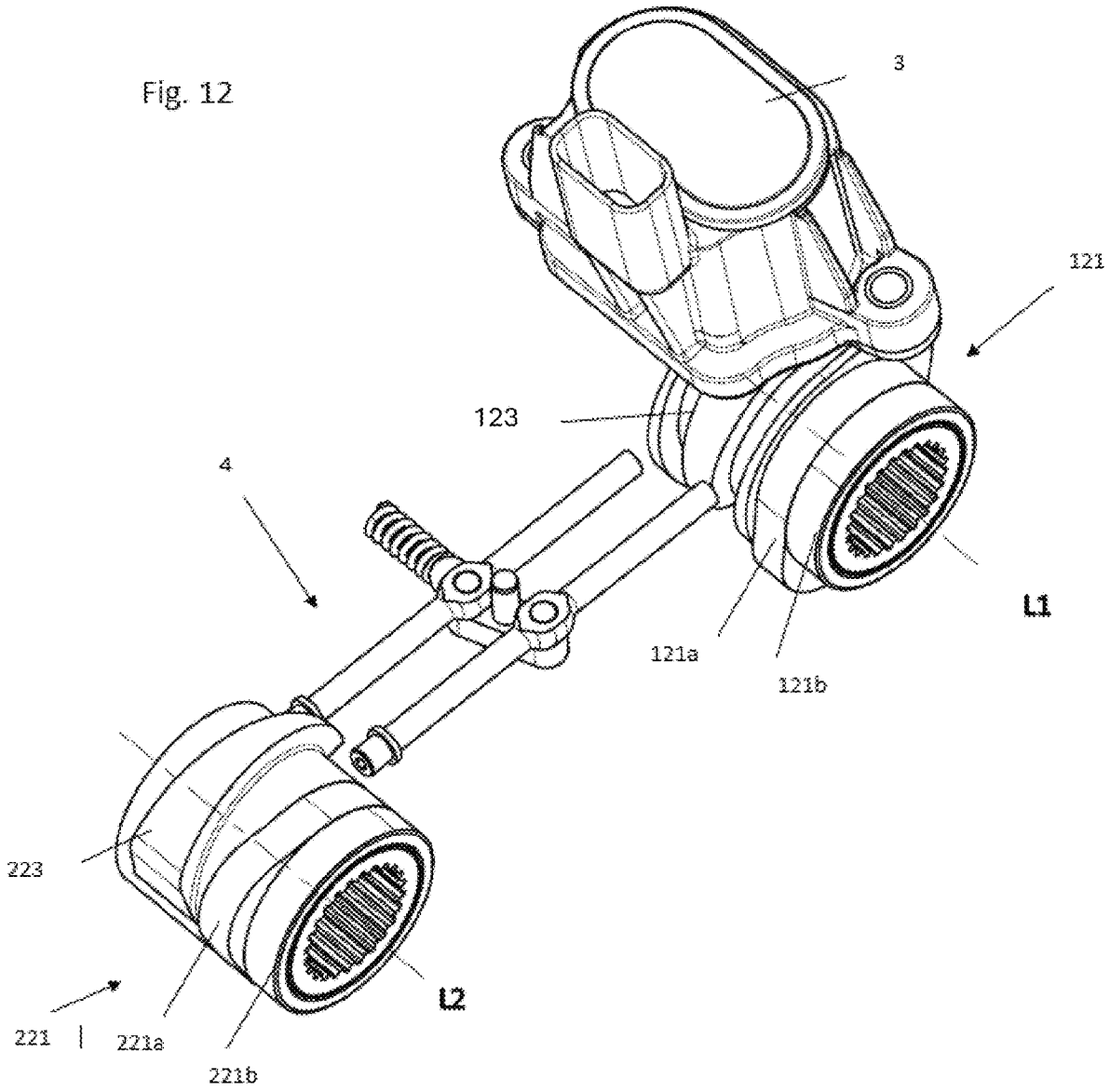
FIG. 12 is a perspective view of a sliding-cam camshaft assembly according to the invention for an internal combustion engine without support shafts.

FIG. 12 shows one embodiment of the invention in such a way that only one inlet and outlet valve per cylinder (not shown) is switched. In this embodiment, the sliding cams 12, 21 per se comprise in each case only one cam pack 121, 221, which cam packs comprise at least two part cams 121*a*, 221*a* and 121*b*, 221*b*, respectively, with different cam contours, and in each case one shift gate 123, 223.

It goes without saying that features and details which are described in conjunction with a method also apply in conjunction with the apparatus according to the invention, and vice versa, with the result that reference is always made or can always be made mutually with regard to the disclosure in respect of the individual aspects of the invention. Moreover, a possibly described method according to the invention can be carried out by way of the apparatus according to the invention.

What is claimed is:

1. A sliding-cam camshaft assembly for an internal combustion engine, comprising:

a first sliding-cam camshaft with a longitudinal axis, the first sliding-cam camshaft comprising a support shaft and at least one sliding cam, the sliding cam comprising a first cam pack, a shift gate, and a second cam pack, a second sliding-cam camshaft with a longitudinal axis, the second sliding-cam camshaft comprising a support shaft and at least one sliding cam, the sliding cam of the second sliding-cam camshaft comprising a first cam pack, a shift gate and, a second cam pack, the first sliding-cam camshaft and the second sliding-cam camshaft being arranged parallel to one another, and the sliding cams of the first sliding-cam camshaft and the second sliding-cam camshaft being arranged on the respective support shaft of the first sliding-cam camshaft and the second sliding-cam camshaft axially displaceably and fixedly for conjoint rotation, a transmission means for transmitting a switching state of the sliding cam of the first sliding-cam camshaft to the sliding cam of the second sliding-cam camshaft being arranged between the first sliding-cam camshaft and the second sliding-cam camshaft, wherein the transmission means comprises a first thrust rod, a second thrust rod, a first actuating means for the first thrust rod and a second actuating means for the second thrust rod, the first actuating means and the second actuating means being attached at an axial spacing, to the sliding cam of the first sliding-cam camshaft or being shaped from said sliding cam of the first sliding-cam camshaft, wherein the first actuating means is configured as a first radial lifting cam profile, the second actuating means is configured as a second radial lifting cam profile, one of the first actuating means and the second actuating means being arranged on one of the first and second sliding-cam camshaft.

2. The sliding-cam camshaft assembly for an internal combustion engine as claimed in claim 1 wherein the first actuating means and the second actuating means are arranged on the shift gate of the sliding cam of the first sliding-cam camshaft at different axial positions.

3. The sliding-cam camshaft assembly for an internal combustion engine as claimed in claim 2 wherein the first thrust rod has a first end which faces the first sliding-cam camshaft, the first thrust rod includes a second end which faces the second sliding-cam camshaft, the second thrust rod includes a first end which faces the first sliding-cam camshaft, the second thrust rod includes a second end which faces the second sliding-cam camshaft.

4. The sliding-cam camshaft assembly for an internal combustion engine as claimed in claim 3 wherein the first thrust rod and the second thrust rod can be displaced between at least two positions:

a first position, in which the first end of the first thrust rod is further away from the first sliding-cam camshaft and the second end of the first thrust rod is closer to the second sliding-cam camshaft, and the first end of the second thrust rod is closer to the first sliding-cam camshaft and the second end of the second thrust rod is further away from the second sliding-cam camshaft, and a second position, in which the first end of the first thrust rod is closer to the first sliding-cam camshaft and the second end of the first thrust rod is further away from the second sliding-cam camshaft, and the first end of the second thrust rod is further away from the first sliding-cam camshaft and the second end of the second thrust rod is closer to the second sliding-cam camshaft.

5. The sliding-cam camshaft assembly for an internal combustion engine as claimed in claim 4 wherein the first thrust rod is coupled via a coupling means to the second thrust rod, the coupling means being configured such that an axial movement of the first thrust rod brings about an opposed axial movement of the second thrust rod.

6. The sliding-cam camshaft assembly for an internal combustion engine as claimed in claim 5 wherein the coupling means is configured as a coupling lever which is connected in an articulated manner to the first thrust rod and the second thrust rod, the coupling lever being attached to a rotational axle between the first thrust rod and the second thrust rod, the rotational axle being oriented perpendicularly with respect to the first thrust rod and the second thrust rod or displacement directions of the first thrust rod and the second thrust rod.

7. The sliding-cam camshaft assembly for an internal combustion engine as claimed in claim 6 wherein the transmission means is equipped with a latching means in a form of a spring/ball mechanism, which is configured to hold the first thrust rod and the second thrust rod releasably in a predefined position.

8. The sliding-cam camshaft assembly for an internal combustion engine as claimed in claim 7 wherein the first thrust rod and the second thrust rod are oriented perpendicularly with respect to the longitudinal direction of the first sliding-cam camshaft and the second sliding-cam camshaft, or in that the first thrust rod and the second thrust rod are oriented at an angle $\alpha$ of between 60° and 80°, with respect to the longitudinal direction of the first sliding-cam camshaft and the second sliding-cam camshaft.

9. The sliding-cam camshaft assembly for an internal combustion engine as claimed in claim 7 wherein the first thrust rod and the second thrust rod are configured as one of (i) in one piece, and (ii) of split configuration as two thrust rod segments and are attached in each of (i) and (ii) in an articulated manner to the coupling means.

10. The sliding-cam camshaft assembly as claimed in claim 7 wherein the sliding cam of the first sliding-cam camshaft comprises four cam packs, and;

the sliding cam of the second sliding-cam camshaft comprises four cam packs.

11. A method for switching a sliding-cam camshaft assembly for an internal combustion engine, the sliding-cam camshaft assembly comprising: a first sliding-cam camshaft with a longitudinal axis, the first sliding-cam camshaft comprising a support shaft and at least one sliding cam, the sliding cam comprising a first cam pack, a shift gate, and a second cam pack; a second sliding-cam camshaft with a longitudinal axis, the second sliding-cam camshaft comprising a support shaft and at least one sliding cam, the sliding cam of the second sliding-cam camshaft comprising a first cam pack, a shift gate and, a second cam pack; the first sliding-cam camshaft and the second sliding-cam camshaft being arranged parallel to one another, and the sliding cams of the first sliding-cam camshaft and the second sliding-cam camshaft being arranged on the respective support shaft of the first sliding-cam camshaft and the second sliding-cam camshaft axially displaceably and fixedly for conjoint rotation; and a transmission means for transmitting a switching state of the sliding cam of the first sliding-cam camshaft to the sliding cam of the second sliding-cam camshaft being arranged between the first sliding-cam camshaft and the second sliding-cam camshaft, wherein the transmission means comprises a first thrust rod and a second thrust rod, wherein the method comprises:

initiating of a switching operation by way of insertion of an actuator pin of an actuator into the shift gate of the at least one sliding cam of the first sliding-cam camshaft, as a result of which the sliding cam of the first sliding-cam camshaft is displaced axially, as a result of which a second actuating means is positioned in front of a first end of the second thrust rod, with the result that the second thrust rod is actuated and is displaced out of a position away from the second sliding-cam camshaft away from the shift gate of the second sliding-cam camshaft, in a direction of the second sliding-cam camshaft into a position close to the second sliding-cam camshaft, as a result of which a second end of the second thrust rod dips into the shift gate of the sliding cam of the second sliding-cam camshaft, and the sliding cam of the second sliding-cam camshaft is displaced axially out of a first switching state into a second switching state, the first thrust rod being coupled to the second thrust rod, with the result that an axial movement of the first thrust rod brings about an opposed axial movement of the second thrust rod, as a result of which the first thrust rod is displaced in a direction of the first sliding-cam camshaft, a first actuating element being positioned next to a first end of the first thrust rod, with the result that the first thrust rod remains in the second switching state as long as the sliding cam of the first sliding-cam camshaft is not transferred again into the first switching state.

* * * * *